US005713554A

United States Patent [19]

Lai

[11] Patent Number: 5,713,554

[45] Date of Patent: Feb. 3, 1998

[54] FOLDABLE PEDESTAL

[76] Inventor: Chung Ho Lai, 9th Fl., 152, Sec. 1, Chung Shiao E. Rd., Taipei, Taiwan

[21] Appl. No.: 582,685

[22] Filed: Jan. 4, 1996

[51] Int. Cl.[6] ..... F16M 13/00

[52] U.S. Cl. ..... 248/522; 248/519

[58] Field of Search ..... 248/524, 522, 248/521, 519, 527, 528, 349.1

[56] References Cited

U.S. PATENT DOCUMENTS

| | | | |
|---|---|---|---|
| 2,005,293 | 6/1935 | Harris | 248/522 |
| 2,469,884 | 5/1949 | Masone | 248/522 |
| 2,527,969 | 10/1950 | Siebenkittel | 248/522 |
| 2,674,147 | 4/1954 | Franklin | 248/522 |
| 3,017,150 | 1/1962 | Kahle | 248/522 |
| 3,042,350 | 7/1962 | Lencioni | 248/522 |
| 3,119,586 | 1/1964 | Hoffman | 248/524 |
| 4,061,306 | 12/1977 | Taylor | 248/523 |
| 4,890,008 | 12/1989 | Chu | 248/522 |
| 4,895,339 | 1/1990 | Yang | 248/522 |
| 5,255,886 | 10/1993 | Wang | 248/522 |

FOREIGN PATENT DOCUMENTS

| | | | |
|---|---|---|---|
| 471137 | 1/1951 | Canada | 248/522 |

*Primary Examiner*—Leslie A. Braun
*Assistant Examiner*—Gwendolyn W. Baxter

[57] ABSTRACT

A pedesdal for holding and supporting a Christmas tree, a flag pole and the like composes of a plural number of separable and foldable base beams, a connection base and a holding tube assembly. The base beams are pivotally engaged with the connection base and can be extended to provided a firm support for a large size Christmas tree or a flag pole, or can be folded into a small space to facilitate transportation and storage. The holding tube assembly composes of an inside sleeve and a bushing which are held within an outside sleeve. There is a protection sleeve disposed within the inside sleeve to allow an electric wire disposed therebetween. A motor is disposed at the bottom of the outside sleeve. The motor can drive the inside sleeve and the bushing to rotate through a gear mechanism. Thereby the Christmas tree or the pole being disposed within the inside sleeve can also be rotated when motor is power on.

1 Claim, 5 Drawing Sheets

FOLDABLE PEDESTAL

BACKGROUND OF THE INVENTION

1. Field of the Invention

The present invention relates to a foldable pedestal which is able to rotate and has light source, and more particularly relates to a pedestal which is able to rotate and has light source and can be used for supporting a Christmas tree, a flag pole and the like.

2. Description of the Prior Art

Natural Christmas tree of wood is scarce and expensive nowadays. Therefore Christmas tree made of plastics is widely used by many families and companies. Conventional Christmas tree has a pedestal which is also made of plastics. It usually needs a relatively large size of pedestal to support a large size Christmas tree. The pedestal which has a fixed form is difficult to transport and store. There is some type of pedestal which can be disassembled to facilitate transportation and storage, however it usually does not well structured, thus cannot provide firm and steady support for a large size Christmas tree. Furthermore conventional Christmas tree is stilly disposed on a pedestal and can only provide a static view. It cannot fully meet consumers' requirements nowadays.

SUMMARY OF THE INVENTION

It is accordingly an object of the present invention to provide a foldable pedestal which is able to rotate and has light source for Christmas tree, flag pole and the like. The pedestal can be extended in a relatively large size to firmly support a large size Christmas tree, flag pole and the like. The pedestal can also be disassembled and folded into small size to facilitate transportation and storage, thereby to reduce the costs of transportation and storage. Furthermore, the pedestal provides a mechanism which can make the Christmas tree or flag pole disposed thereon to rotate slowly, thus making the object disposed on the pedestal looks more appealing.

It is another object of the present invention to provide a rotary and foldable pedestal which has greater stress bearing capability and higher supporting steadiness, thus can support a larger size or higher Christmas tree, flag pole and the like. Or a smaller pedestal can be used for supporting a Christmas tree or flag pole that otherwise need a larger size of conventional pedestal. Therefore it can save the space and the costs of transportation and storage.

Additional advantages of the present invention will be made apparent in the following description of the accompanying referenced drawings. The drawings are only for the purpose of illustration and should not be considered as the limit of the scope of the present invention.

DESCRIPTION OF THE PREFERRED EMBODIMENT

Figure 1:
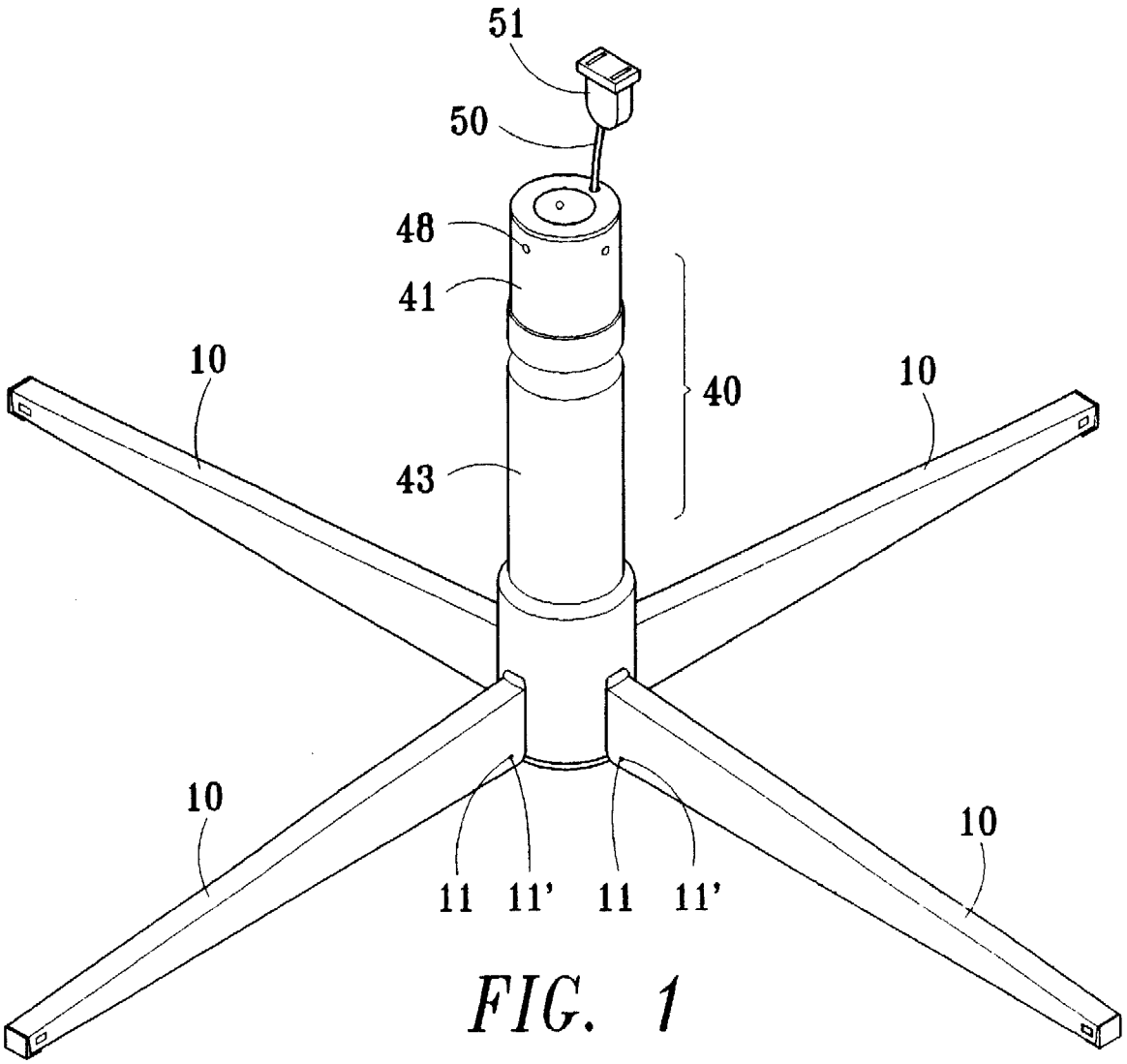
FIG. 1 is a perspective view of the present invention.
Figure 2:
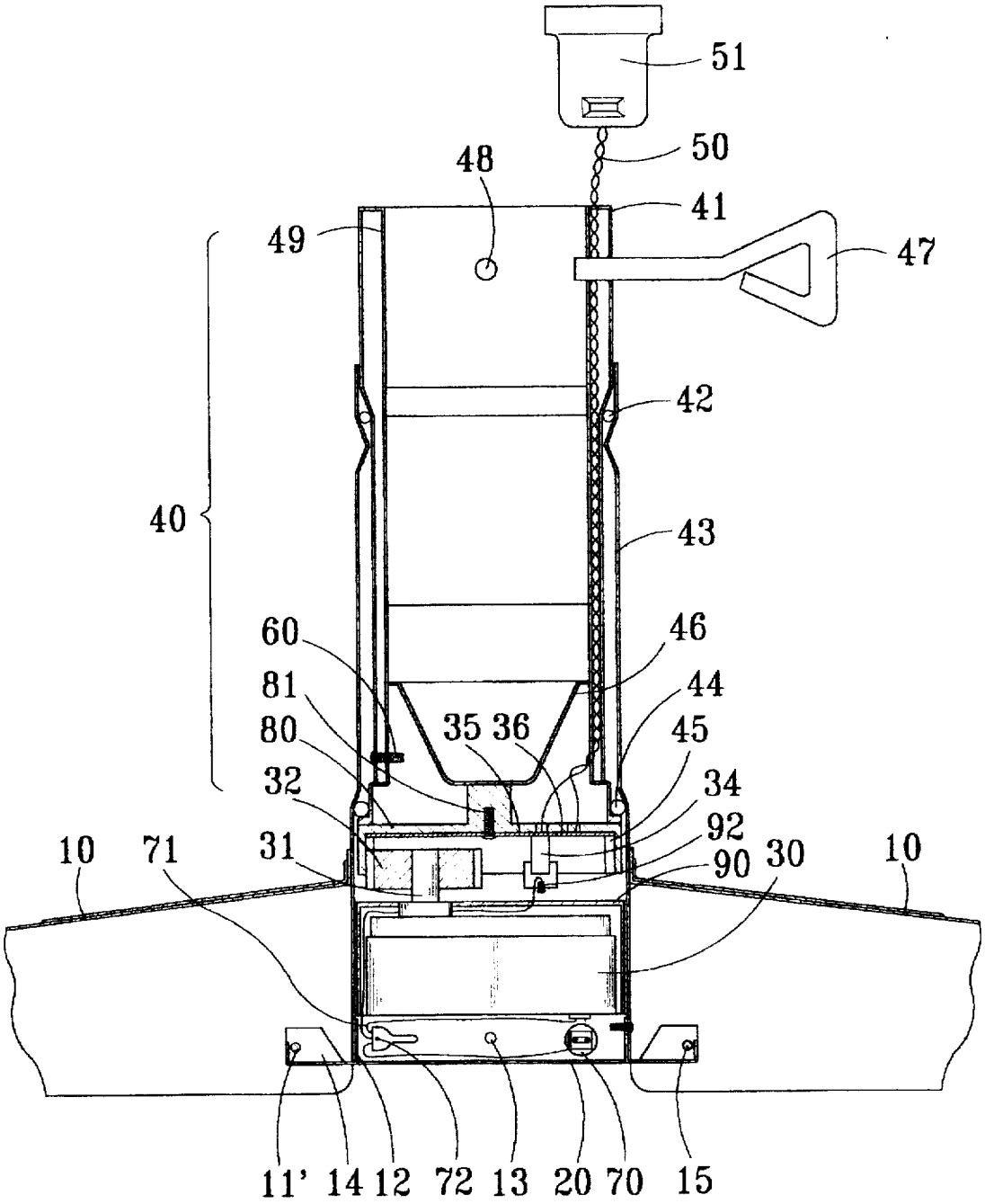
FIG. 2 is a cross sectional view of the present invention in use state.
Figure 3:
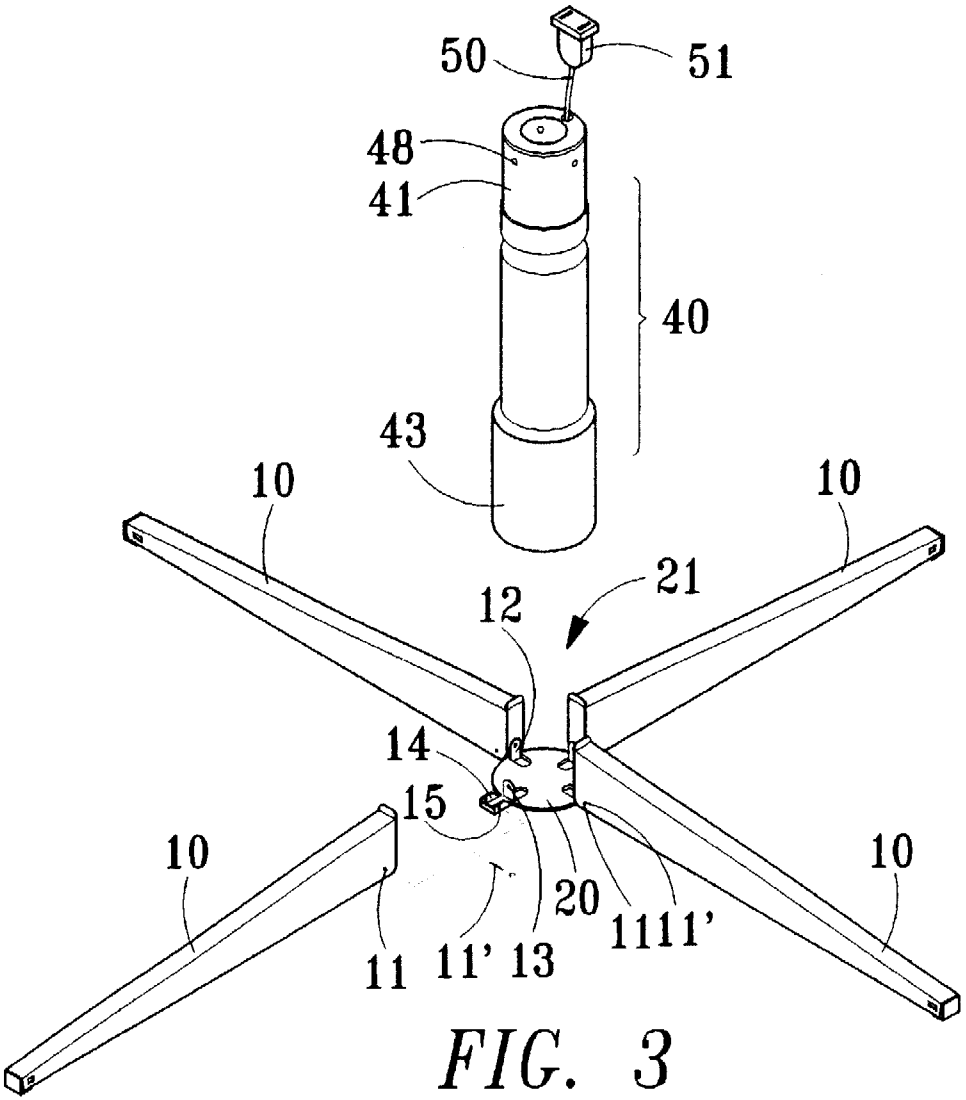
FIG. 3 is an exploded view of the present invention.
Figure 4:
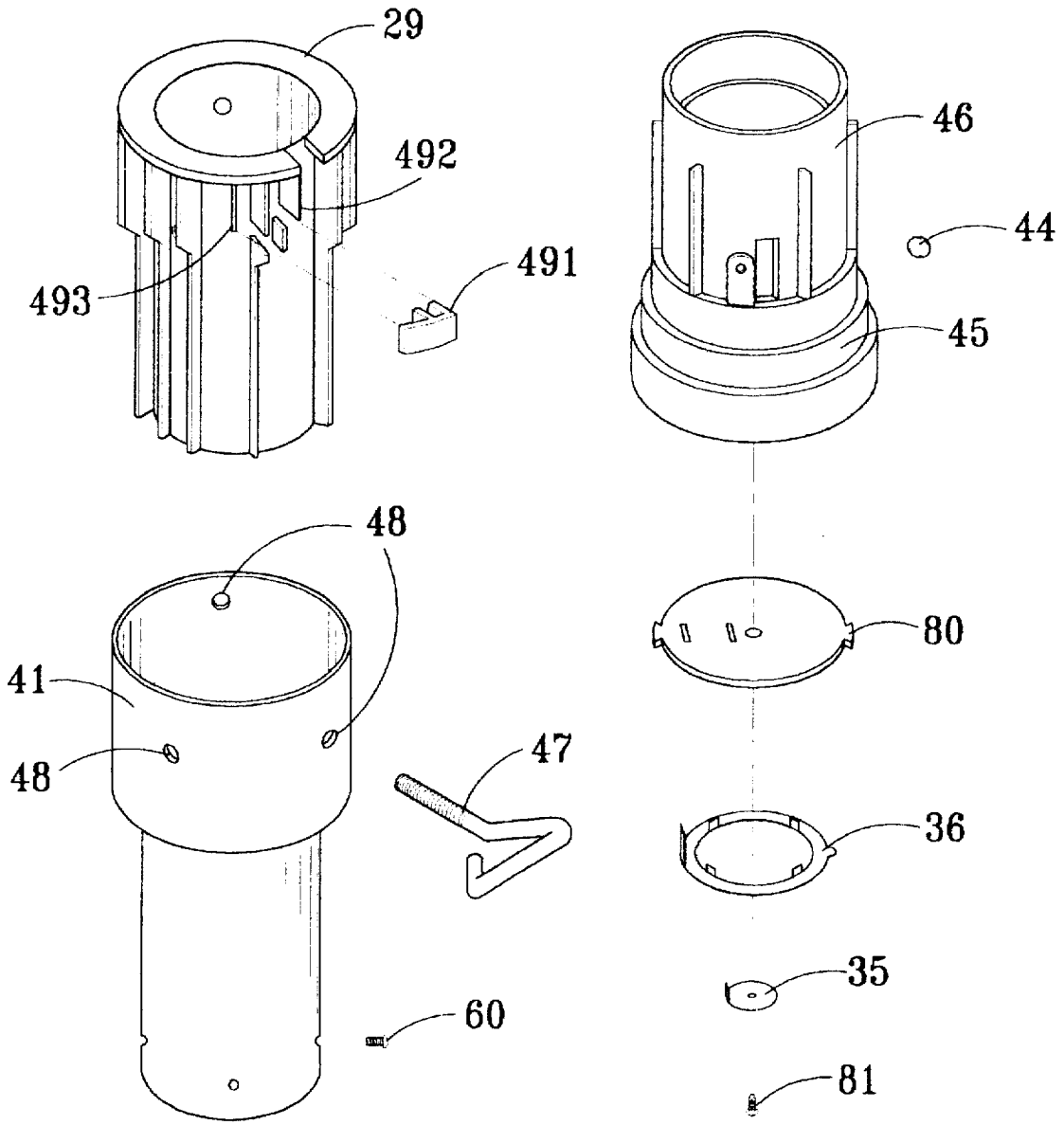
FIG. 4 is an exploded view of the upper portion of the present invention.
Figure 5:
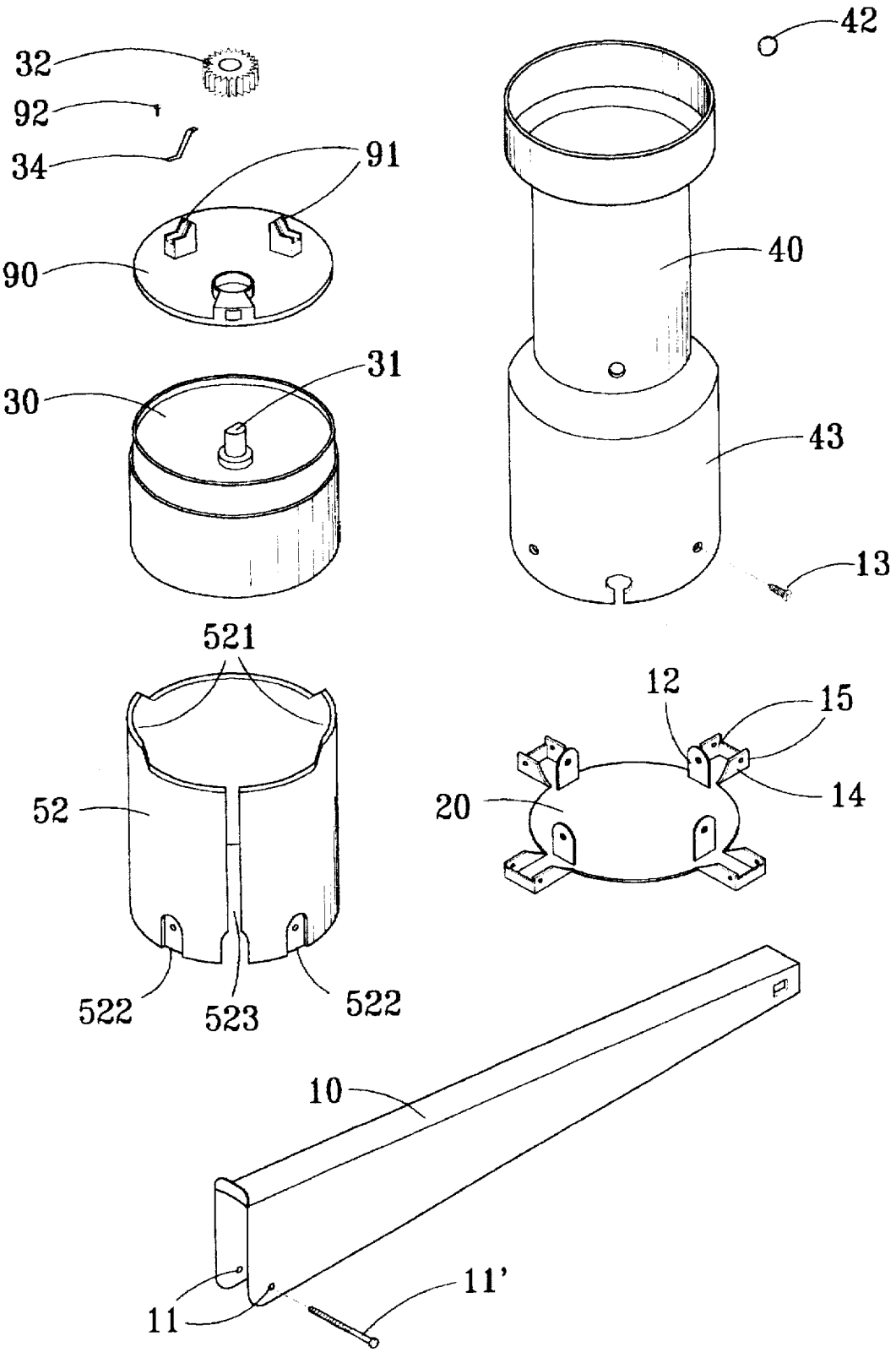
FIG. 5 is an exploded view of the lower portion of the present invention.

Referring to FIG. 1 through FIG. 5, the present invention comprises mainly a plurality of separable base beams 10, a connection base 20, a motor 30 and a holding tube assembly 40. Connection base 20 serves as a hub to hold the base beams 10 together, and to allow the holding tube assembly 40 be disposed thereon.

The connection base 20 is substantially flat and circular. There is a plurality of substantially upright protrusions 12 formed around the circumference of connection base 20. Each protrusion 12 has an aperture 13 formed thereon. The connection base 20 further extends radially outward and forms a plural number of protrusions 14 which have an "U" shape flange. There are pin holes 15 formed respectively on the "U" shape flange of the protrusions 14.

Base beam 10 is a hollow trapezoid structure which is higher at the center end and tapers at the outside end. On the side walls of the higher end there are pin holes 11 formed thereon horizontally which mate against the pin holes 15 on the connection base 20. A base beam 10 is then pivotally engaged with the connection base 20 by means of disposing a pin 11' on the pin holes 11 and 15. Thus base beam 10 can be turned about the pin 11' and folded into a small space for easy of transportation and storage, or can be spread and extended on the same plane as that of the connection base 20 to form a large supporting base as shown in FIG. 1. When the base beam 10 is spread and extended in use state as shown in FIG. 1, there is a groove 21 formed in the center above the connection base 20 and allows holding tube assembly 40 to be disposed therein. The holding tube assembly 40 has an outside sleeve 43 which can be disposed in the groove 21 and be screwed with the connection base 20 through the aperture 13 on the protrusion 12.

Holding tube assembly 40 composes of a protection sleeve 49, an inside sleeve 41, a large gear 45, a bushing 46 and an outside sleeve 43. The protection sleeve 49 is disposed within the inside sleeve 41 and has an electrical wire 50 disposed therebetween. One end of the wire 50 connects with a power plug 51. At the other end, the wire 50 connects with a conduction disk 35 and a conduction annular ring 36 separately. There is a protection cap 491 covers an opening 492 formed in the protrusive flange of protection sleeve 49 to prevent the wire 50 extended out through opening 493 from being cutting or damaging. Inside sleeve 41 is disposed within the outside sleeve 43. There are two rows of steel balls 42 and 44 disposed between the inside sleeve 41 and outside sleeve 43 respectively at the upper and lower section to serve as bearings.

On the upper circumference of the inside sleeve 41, there are a plurality of screw holes 48 formed thereon. A tree or pole means can be firmly engaged in the inside sleeve 41 by means of screw 60. In the mean time, it is also firmly disposed inside of the upper section of the inside sleeve 41 by means of using a latch pin 47 engaging with the aperture 48 and the tree or pole means.

At the lower section of outside sleeve 43, there is a motor 30 disposed therein. Motor spindle 31 engages with a gear 32 which in turn engages with a large gear 45. Large gear 45 is disposed within the internal circumference of the inside sleeve 41. The top of large gear 45 engages with a holding disk 80 through a screw 81. Above the large gear 45, there is provided a sleeve 46 disposed from the bottom of inside sleeve 41 and firmly engaged with the inside sleeve 41 through screw 60. Above motor 30, there is provided brush bracket board 90 with two brush brackets 91 disposed thereon. Brush bracket 91 engages with a brush 34 and brush wire 71 through a screw 92. Brush 34 makes contact with conduction disk 35 and conduction annular ring 36 disposed on the holding disk 80.

Outside motor 30, there is provided a sleeve 52 which has a slot 523 on the lateral wall, two openings 521 on the top and four concave recesses 522 at the bottom. Recess 522 matches with upright protrusion 12 on the connection base 20 and is engaged thereof through a screw 13. Thus sleeve 52 is also being engaged with the outside sleeve 43.

Motor 30 has an electric wire disposed in a duct 70 which runs through the outside sleeve 43 and sleeve 52. Power supply connects respectively with motor electric wire and brush wire 71 through a plug 72. Brush wire 71 runs through slot 523 and connects with brush 34 through screw 92 to connect with power supply. Thereby when power on, inside sleeve 41 can rotates slowly through large gear 45 and gear 32 in the motor 30.

When the present invention is put to use, the base beam 10 is firstly extended and spreaded on the floor. Then a pole and the like is disposed into the protection sleeve 49. Latch pin 47 further set the pole firmly through screw hole 48. When motor 30 is powered on and rotated, the inside sleeve 41 and the pole inside will also be driven to rotate. Light can also be provided for creating amusement effect. As the base beam 10 can be extended to a large floor space, it can therefore provides a steady and firm support for a relatively large size Christmas tree, pole and the like.

When the present invention is not in use and to be transported or stored, the base beam 10 can be pivotally turned about pin 11' and be folded against the axial line perpendicular to the center of connection base 20. Holding tube assembly 40 can also be disconnected from connection base 20. Thus all components of the present invention can be packed in a relatively small space to facilitate transportation and storage. The total costs of transportation and storage can also be reduced. It is thus clear that the objects of the present invention set forth herein, as well as those made apparent from the foregoing description, are efficiently attained. While the preferred embodiment of the invention has been set forth for purpose of disclosure, modifications of the disclosed embodiment of the invention as well as other embodiments thereof may occur to those skilled in the art.

Accordingly, the appended claims are intended to cover all embodiments which do not depart from the spirit and the scope of the invention.

I claim:

1. A foldable and rotatable pedestal comprising:

a substantially flat connection base with a plurality of base beams pivotably attached thereto, said base beams include pin holes in a first end thereof, said base includes a plurality of holding flanges to receive said base beams, said holding flanges act as a hinge such that said base beams pivot about said pin holes, a holding tube assembly comprising a protection sleeve, and inside sleeve, a large gear, a bushing, an outside sleeve, and a motor; wherein said protection sleeve is disposed within said inside sleeve, an electric wire is disposed between said protection sleeve and said inside sleeve, said electric wire has a first end that engages a power plug and a second end that engages a conduction disk and a conduction annular ring, said conduction disk and said conduction annular ring are disposed on a holding disk, said inside sleeve is disposed within said outside sleeve and is separated from said outside sleeve by rows of steel ball bearings which are disposed around an upper and a lower circumference of said outside sleeve, said inside sleeve further includes a bottom sleeve that engages said large gear;

said motor is disposed in an interior of said outside sleeve at a lower end thereof, said motor includes a spindle with a gear thereon, said gear engages said large gear, said large gear engages said bushing which engages said inside sleeve, said motor further engages said holding disk, such that when said motor is powered on, said inside sleeve rotates.

* * * * *